US007641594B2

(12) United States Patent
Hickey

(10) Patent No.: US 7,641,594 B2
(45) Date of Patent: Jan. 5, 2010

(54) APPARATUS FOR COOLING TRAMPOLINES

(76) Inventor: Charles Joseph Hickey, 41 Country Club Pl., Belleville, IL (US) 62223

( * ) Notice: Subject to any disclaimer, the term of this patent is extended or adjusted under 35 U.S.C. 154(b) by 591 days.

(21) Appl. No.: 11/065,762

(22) Filed: Feb. 25, 2005

(65) Prior Publication Data

US 2006/0194674 A1 Aug. 31, 2006

(51) Int. Cl.
*A63B 5/11* (2006.01)

(52) U.S. Cl. ..... 482/29; 239/289

(58) Field of Classification Search ..... 482/23, 482/26–29, 35, 36, 74, 77, 78; 472/128, 472/92, 93, 116, 117, 129, 134–137; 446/197; D21/797, 826, 827; 182/137–139; 239/279, 239/280, 289, 566
See application file for complete search history.

(56) References Cited

U.S. PATENT DOCUMENTS 2,770,812 A * 11/1956 Whiteside ..... 4/615
2,940,466 A * 6/1960 Speights ..... 239/289
3,363,268 A * 1/1968 Friedlander ..... 4/506
3,933,311 A * 1/1976 Lemelson ..... 239/289
D287,909 S * 1/1987 Weiss ..... D6/329
5,741,189 A * 4/1998 Briggs ..... 472/128
5,862,990 A 1/1999 White
5,941,798 A 8/1999 Coan et al.
6,081,944 A 7/2000 Edwards
6,155,495 A 12/2000 Jones
6,161,362 A * 12/2000 Forbis et al. ..... 52/745.06
D478,956 S * 8/2003 Feuer ..... D21/815
7,037,220 B1 * 5/2006 Gordon ..... 473/466
2002/0137598 A1 * 9/2002 Publicover et al. ..... 482/27
2005/0043122 A1 * 2/2005 Publicover et al. ..... 473/465
2006/0160664 A1 * 7/2006 Lavabre ..... 482/27
2007/0066447 A1 * 3/2007 Overholt ..... 482/27

FOREIGN PATENT DOCUMENTS

CA 2470718 A1 * 12/2005

* cited by examiner

*Primary Examiner*—Loan H Thanh
*Assistant Examiner*—Victor K Hwang
(74) *Attorney, Agent, or Firm*—Armstrong Teasdale LLP

(57) ABSTRACT

A cooling system for a trampoline includes an enclosure assembly and a sprinkling system. The enclosure assembly includes a frame and a net. The enclosure assembly is configured to couple to the trampoline and extend upwardly therefrom. The frame includes a plurality of supports spaced about an outer periphery of the trampoline. The net is configured to couple to the plurality of supports such that the net substantially circumscribes the trampoline. The sprinkling system is coupled to at least one of the frame sub-assembly or the net. The cooling system includes a plurality of discharge openings positioned a height above the trampoline for spraying cooling fluid radially inward above the trampoline. The plurality of discharge openings are configured to be coupled in flow communication with a source of cooling fluid.

19 Claims, 2 Drawing Sheets

APPARATUS FOR COOLING TRAMPOLINES

BACKGROUND OF THE INVENTION

This invention relates generally to trampolines, and, more particularly, to methods and apparatus for supplying cooling fluid to trampolines.

Trampolines are well known in the art for providing both recreation and/or physical fitness exercise to users of the trampolines. Because of their overall size, and because of height restrictions, generally trampolines are used in gymnasiums or outdoors. Those trampolines used outdoors are generally used in locations that are not climate controlled and that may be exposed to sunlight. As a result, the combination of the environmental conditions present at the location of the trampoline and the physical exertion of the user(s) may increase the temperature of the trampoline and that of any user(s), and thus diminish the enjoyment and potential health benefits of the users on the trampoline.

To facilitate reducing an operating temperature of the trampoline at least some known trampolines include water spray devices. For example, U.S. Pat. No. 5,862,990 describes a trampoline water spray device that is coupled circumferentially around the trampoline to the frame supporting the trampoline mat at an elevated location above the ground. Similarly, U.S. Pat. No. 6,155,495 describes a trampoline sprinkler system that is coupled circumferentially about the trampoline to the frame supporting the trampoline mat at an elevated location above the ground. In both of the aforementioned systems water is discharged upwardly and radially inward when the systems are activated. However, because of the discharge location of the water, the effectiveness of each system would be diminished if coupled to a trampoline including a safety net as the cooling water would have to pass through the net assembly before reaching its intended cooling location.

BRIEF DESCRIPTION OF THE INVENTION

In one aspect, a trampoline is provided. The trampoline includes a trampoline mat, a frame, an enclosure assembly, and a cooling system. The trampoline frame includes an upper support and a plurality of stanchions. Each of the plurality of stanchions extends between the upper support and the ground. The upper support is coupled to an outer periphery of the trampoline mat. The enclosure assembly includes a frame sub-assembly and a net. The enclosure assembly is coupled to the trampoline frame and extends upwardly therefrom. The frame sub-assembly includes a plurality of supports spaced at intervals circumscribing the trampoline mat. Each of the plurality of supports includes a first end and a second end. Each support first end is coupled to the frame upper support such that the support extends upwardly from the frame upper support. The net is coupled to the plurality of supports such that the net substantially circumscribes the trampoline mat. The cooling system is coupled to at least one of the plurality of supports or the net. The cooling system includes an inlet and a plurality of discharge openings positioned a height above the trampoline mat for spraying cooling fluid radially inward above the trampoline mat. The plurality of discharge openings are in flow communication with the inlet.

In another aspect, an enclosure assembly for a trampoline including a mat supported by a frame is provided, wherein the frame includes an upper support that is coupled to and supports the mat a height above the ground. The enclosure assembly includes a frame sub-assembly, a net, and a cooling system. The frame sub-assembly includes a plurality of supports spaced at intervals circumscribing the trampoline mat. Each of the plurality of supports is coupled to the trampoline frame and extends upwardly therefrom. The net is coupled to the plurality of supports such that the net substantially circumscribes the trampoline mat. The cooling system is coupled to at least one of the frame sub-assembly or the net. The cooling system includes a plurality of discharge openings positioned a height above the trampoline mat for spraying cooling fluid radially inward above the trampoline mat. The plurality of discharge openings are coupled in flow communication with a source of cooling fluid.

In yet another aspect, a cooling system for a trampoline is provided. The cooling system includes an enclosure assembly and a sprinkling system. The enclosure assembly includes a frame and a net. The enclosure assembly is configured to couple to the trampoline and extend upwardly therefrom. The frame includes a plurality of supports spaced about an outer periphery of the trampoline. The net is configured to couple to the plurality of supports such that the net substantially circumscribes the trampoline. The sprinkling system is coupled to at least one of the frame sub-assembly or the net. The cooling system includes a plurality of discharge openings positioned a height above the trampoline for spraying cooling fluid radially inward above the trampoline. The plurality of discharge openings are configured to be coupled in flow communication with a source of cooling fluid.

DETAILED DESCRIPTION OF THE INVENTION

Figure 1:
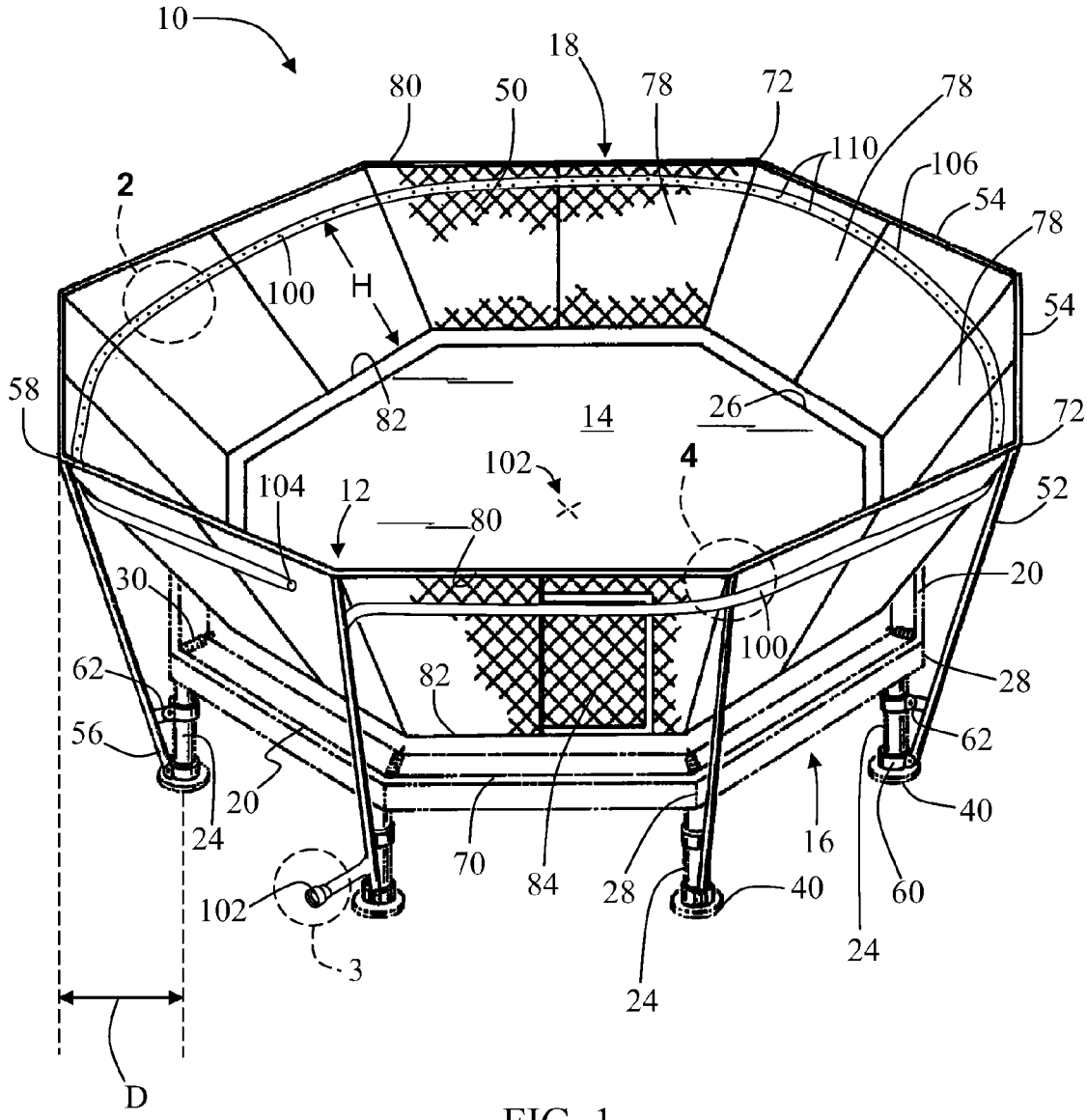
FIG. 1 is a perspective view of an exemplary trampoline including a cooling fluid delivery system.
Figure 2:
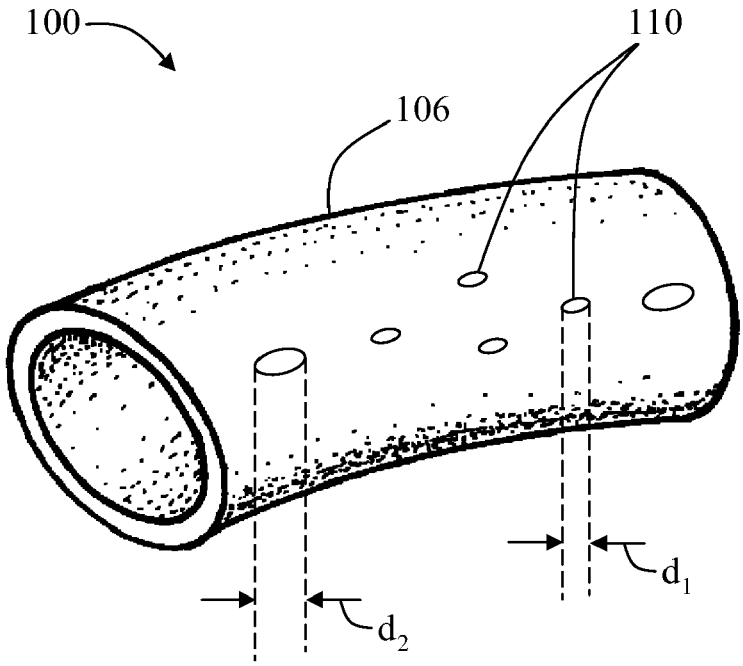
FIG. 2 is a perspective view of a portion of the cooling fluid delivery system shown in FIG. 1 and taken along area 2.
Figure 3:
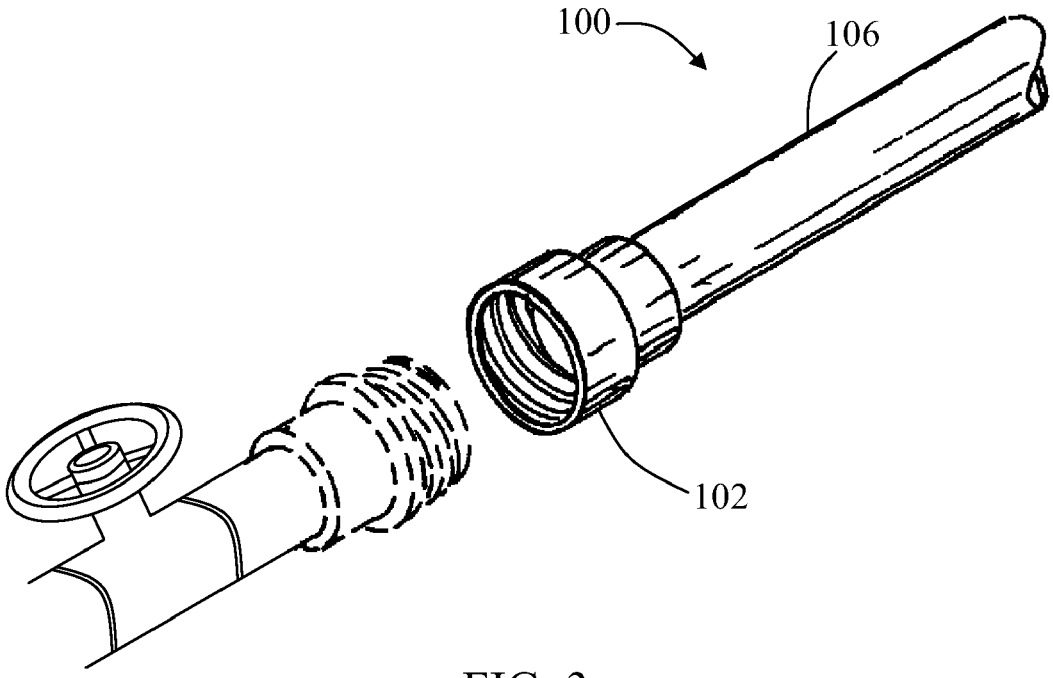
FIG. 3 is a perspective view of a portion of the cooling fluid delivery system shown in FIG. 1 and taken along area 3.

FIG. 1 is a perspective view of an exemplary trampoline 10 including a cooling fluid delivery system 12. FIG. 2 is a perspective view of a portion of cooling fluid delivery system 12 taken along area 2. FIG. 3 is a perspective view of a portion of cooling fluid delivery system 12 taken along area 3. Trampoline 10 is known in the art and includes a trampoline mat 14, a frame assembly 16, and a net assembly 18. In the exemplary embodiment, mat 14 is octangal-shaped and is sized to support a plurality of users thereon. The overall size and shape of mat 14 are variably selected depending upon the desired use of trampoline 10.

In the exemplary embodiment, frame assembly 16 includes a plurality of mat or upper support members 20 and a plurality of stanchions 24. Mat support members 20 are interconnected together substantially symmetrically about an outer periphery 26 of mat 14. Adjacent members 20 are connected together at a corner 28 such that members 20 form an annular structure. More specifically, in the exemplary embodiment, when members 20 are fully assembled, members 20 define an octagon. In an alternative embodiment, frame assembly 16 may include an annular mat support member that is sized and shaped to circumscribe mat 14.

In the exemplary embodiment, mat 14 is coupled to frame assembly 16 by a plurality of spring members 30 that extend between mat 14 and a respective mat support member 20. As such, when fully assembled, spring members 30 circumscribe mat 14 at spaced intervals about mat outer periphery 26. Moreover, when fully assembled, mat 14 is coupled to members 20 via spring members 30 such that mat 14 is suspended radially within frame assembly 16, and such that members 30 are generally co-planar with mat 14.

Stanchions 24 extend generally perpendicularly downward from frame members 20 at spaced intervals about mat 14, such that mat 14 is elevated above the ground. More specifically, in the exemplary embodiment, each of eight stanchions 24 is coupled to a pair of adjacent members 20 at each respective corner 28. Alternatively, more or less stanchions 24 may be used, and/or stanchions 24 may be coupled to only a single member 20. In the exemplary embodiment, stanchions 24 extend between frame members 20 and the ground or surface that supports trampoline 10.

Each stanchion 24 includes a base 40 that is adjustably coupled to a lower end 42 of each stanchion 24 to support trampoline 10 against the ground or surface supporting trampoline 10. In the exemplary embodiment, each base 40 is threadably coupled to each stanchion 24 and stanchions 24 are adjustable to facilitate leveling trampoline mat 14 within a generally horizontal plane. More specifically, as is known in the art, adjustments of stanchions 24 facilitate raising or lowering portions of trampoline mat 14 and frame members 20 with respect to the supporting ground. In addition, stanchions 24 facilitate limited control of the height of elevation of mat 14 with respect to the ground.

In the exemplary embodiment, net assembly 18 includes a net 50, a plurality of net upright supports 52, and a plurality of lateral supports 54. Upright supports 52 each include a lower end 56 and an upper end 58. In the exemplary embodiment, each support lower end 56 is securely coupled via a band clamp 60 to a respective stanchion lower end 42. An upper support band clamp 62 is coupled to, and extends, between each stanchion 24 and each upright support 52. More specifically, in the exemplary embodiment, each upper support band clamp is positioned between each band clamp 60 and each corner 28. In the exemplary embodiment, supports 52 are each hollow.

When each upright support 52 has been coupled to each respective stanchion 24 each support 52 extends generally vertically from each respective stanchion base 40. More specifically, in the exemplary embodiment, each support 52 is obliquely oriented with respect to the ground such that each support upper end 58 is positioned a larger radial distance D outward from each frame support 20 than each respective support lower end 56. Moreover, when each upright support 52 has been coupled to each respective stanchion 24, supports 52 circumscribe mat 14 at spaced intervals about an outer periphery 70 of frame assembly 16 as defined by support members 20. In an alternative embodiment, stanchions 24 may extend vertically upward from frame members 20 to form upright supports for use with net assembly 18.

In the exemplary embodiment, lateral supports 54 are hollow and are interconnected together substantially symmetrically such that adjacent supports 54 are connected together at corners 72 and such that supports 54 define an annular structure. More specifically, in the exemplary embodiment, when supports 54 are fully assembled, supports 54 define an octagon shape. In an alternative embodiment, net assembly 18 may include an annular lateral support member that is sized and shaped to interconnect supports 54. In another alternative embodiment, all of supports 54 are not interconnected together, but rather only pairs of adjacent supports 54 are connected together.

In the exemplary embodiment, net 50 is fabricated from a plurality of panels 78 that are connected together and are coupled to supports 54 to facilitate constraining each user utilizing trampoline 10. More specifically, in the exemplary embodiment, an upper edge 80 of net 50 is coupled to lateral supports 54, and a lower edge 82 of net 50 is coupled to mat outer periphery 26. As such, in the exemplary embodiment, net assembly 18 defines an inverted frusto-conical shape, such that each net panel is oriented obliquely with respect to the ground. In the exemplary embodiment, at least one net panel 78 includes a flap door 84 that enables a user to access and egress from trampoline mat 14.

Cooling fluid delivery system 12 includes at least one piece of tubing 100 that is coupled to, or formed integrally with net assembly 18 at a height H above trampoline mat 14 for discharging cooling fluid generally radially inwardly towards a center 101 of trampoline mat 14. More specifically, in the exemplary embodiment, tubing 100 is coupled to net 50 and to at least one upright support 52. Alternatively, at least a portion of cooling fluid delivery system 12 may be formed integrally with a portion of trampoline 10, such as, but not limited to, frame assembly 16, and/or net assembly 18.

Tubing 100 is hollow and includes an inlet end 102, a capped end 104, and a tubing body 106 extending therebetween. Inlet end 102 enables tubing 100 to be coupled to a pressurized source of cooling fluid. In the exemplary embodiment, inlet end 104 is a female threaded connector that enables tubing 100 to be coupled to a male connector extending from a known garden hose. Alternatively, inlet end 104 may be, but is not limited to being, a male connector, a quick disconnect, an interconnect, a sleeve coupler, or any other coupling mechanism that enables tubing 100 to be coupled to pressurized source of cooling fluid.

Tubing capped end 104 is capped to prevent fluid flow from exiting tubing body 106 therethrough. End 104 may be capped in any known manner that prevents fluid from exiting from tubing body 106 such as, but not limited to, through fusing, molding, clamping, or gluing a cap to end 104.

In the exemplary embodiment, tubing body 106 is perforated with a plurality of openings 110 that extend into a flow passage 112 defined within hollow tubing 100. Accordingly, openings 110 are in flow communication with the inlet end 102 and the pressurized source of cooling fluid for discharging cooling fluid generally radially inward towards trampoline mat center 102. A distance of separation between adjacent openings 110, the diameter of openings 110, the cross-sectional shape of openings 110, the number of openings 110, and the relative location of openings 110 are each variably selected to facilitate a desired spray pattern across trampoline mat 14 and to achieve a desired cooling of trampoline users. In one embodiment, as illustrated in FIG. 2, tubing 100 includes a first plurality of openings that are sized with a first diameter, $d_1$, and a second plurality of openings that are each sized with a second diameter, $d_2$, that is larger than the first diameter $d_1$. Because the first openings are positioned between the second openings and the inlet, the variance in opening diameter facilitates a more uniform spray of cooling fluid across trampoline mat 14.

In the exemplary embodiment, openings 110 are sized, shaped, spaced, and located such that cooling fluid discharged from openings 110 is discharged in a mist-like fashion across trampoline mat 14. In other embodiments, tubing openings 110 are formed in a plurality of nozzles that facilitate enhanced control of the spray pattern of cooling fluid discharged from cooling system 12.

Figure 4:
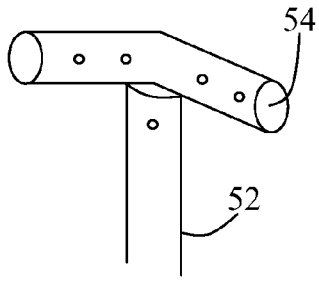
FIG. 4 is an enlarged perspective view of a portion of the cooling fluid delivery system shown in FIG. 1 viewed from a center of the trampoline.

In another embodiment, inlet end 102 is coupled to a known pressure regulator that facilitates controlling a discharge pressure of cooling fluid from tubing 100 and facilitates controlling a spray depth of cooling fluid across mat 14, and a height of discharged cooling fluid relative to mat 14. In another embodiment, inlet end 102 is coupled to a control valve, such as an on/off valve or a time-controlled valve, as shown in shadow in FIG. 3, that controls the flow of fluid entering cooling fluid delivery system 12. In a further embodiment, tubing 100 is at least partially routed through at least one upright support 52 and/or lateral support 54, such that the respective support 52 and/or 54 facilitates shielding at least a portion of tubing 100. In yet another embodiment, at least one upright support 52 and/or lateral support 54 is coupled in flow communication with tubing 100 such that at least a portion of cooling fluid is routed through each support 52 and/or 54. Moreover, in at least some embodiments, as shown in FIG. 4, at least one support 52 and/or 54 includes at least one discharge opening formed therein at a height above mat 14, such that at least some cooling fluid routed through supports 52 and/or 54 is discharged radially inward towards mat center 102.

The above-described trampoline cooling system is cost-effective and provides an effective means for cooling trampoline users over other known systems. The cooling system includes tubing that is coupled to a net assembly at a height above the trampoline mat such that the cooling effectiveness of the cooling system is enhanced. As a result, the cooling system facilitates increased cooling of trampoline users in a cost-effective and reliable manner Exemplary embodiments of trampoline cooling systems are described above in detail. The assemblies are not limited to the specific embodiments described herein, but rather, components of each assembly may be utilized independently and separately from other components described herein. For example, each cooling system component and/or trampoline component can also be used in combination with other trampolines.

While the invention has been described in terms of various specific embodiments, those skilled in the art will recognize that the invention can be practiced with modification within the spirit and scope of the claims.

What is claimed is:

1. A trampoline comprising: a trampoline mat; a trampoline frame comprising an upper support and a plurality of stanchions, each of said plurality of stanchions extending between said upper support and the ground, said upper support coupled to an outer periphery of said trampoline mat; an enclosure assembly comprising a frame sub-assembly, a cooling system, and a net, said enclosure assembly coupled to said trampoline frame and extending upwardly therefrom, said frame sub-assembly comprises a plurality of supports spaced at intervals circumscribing said trampoline mat, each of said plurality of supports comprises a first end and a second end, each support first end is coupled and extends upwardly from one of said plurality of stanchions, said net coupled to said plurality of supports such that said net substantially circumscribes said trampoline mat, said cooling system formed integrally with at least one of said plurality of supports and said net, said cooling system comprising an inlet and a plurality of discharge openings positioned a height above said trampoline mat for spraying cooling fluid radially inward from above said trampoline mat, said plurality of discharge openings are in flow communication with said inlet and are spaced substantially circumferentially about said trampoline mat.

2. A trampoline in accordance with claim 1 wherein said cooling system comprises tubing coupled to said enclosure assembly such that said tubing at least partially circumscribes said trampoline mat, at least a portion of said plurality of discharge openings are formed within said tubing.

3. A trampoline in accordance with claim 1 wherein at least one of said plurality of supports comprises at least one opening coupled in flow communication with said fluid spray system inlet, said at least one opening for spraying cooling fluid radially inward above said trampoline mat.

4. A trampoline in accordance with claim 1 wherein said frame sub-assembly comprises at least one lateral support member coupled between an adjacent pair of said a plurality of supports, said lateral support member comprises at least one opening formed therein for spraying cooling fluid radially inward above said trampoline mat.

5. A trampoline in accordance with claim 1 wherein said cooling system further comprises at least one regulator for controlling the discharge pressure of cooling fluid from said plurality of discharge openings.

6. A trampoline in accordance with claim 1 wherein said cooling system plurality of discharge openings comprise a plurality of first openings having a first diameter and at least one second opening having a second diameter.

7. An enclosure assembly for a trampoline including a mat supported by a frame, wherein the frame includes an upper support that is coupled to and supports the mat a height above the ground, said enclosure assembly comprises a frame sub-assembly comprising a plurality of enclosure supports spaced at intervals circumscribing the trampoline mat, each of said plurality of enclosure supports coupled to the trampoline frame and extending upwardly therefrom, a net coupled to said plurality of supports such that said net substantially circumscribes the trampoline mat; and a cooling system formed integrally with at least one of said frame sub-assembly and said net, said cooling system comprising a plurality of discharge openings positioned a height above said trampoline mat for spraying cooling fluid radially inward above said trampoline mat, said plurality of discharge openings are spaced substantially circumferentially about said trampoline mat and are coupled in flow communication with a source of cooling fluid.

8. An enclosure assembly in accordance with claim 7 wherein said cooling system discharge openings comprise a plurality of first openings positioned at a first height above the trampoline mat and a plurality of second openings positioned at a second height above the trampoline mat.

9. An enclosure assembly in accordance with claim 7 wherein said cooling system discharge openings comprise a plurality of first openings formed with a first diameter and a plurality of second openings formed with a second diameter.

10. An enclosure assembly in accordance with claim 7 wherein at least one of said plurality of supports is hollow and is coupled in flow communication between said plurality of discharge openings and the source of cooling fluid.

11. An enclosure assembly in accordance with claim 7 wherein at least one of said plurality of supports is hollow and comprises at least one opening formed therein, said opening is coupled in flow communication with the source of cooling fluid for discharging cooling fluid radially inwardly above the trampoline mat.

12. An enclosure assembly in accordance with claim 7 wherein said frame sub-assembly comprises at least one lateral member extending between an adjacent pair of said plurality of supports.

13. An enclosure assembly in accordance with claim 12 wherein said at least one lateral member is hollow and comprises at least one opening for discharging cooling fluid radially inwardly above the trampoline mat.

14. A cooling system for a trampoline, said cooling system comprising: an enclosure assembly comprising a frame and a net, said enclosure assembly configured to couple to said trampoline and extend upwardly therefrom, said frame comprises a plurality of supports spaced about an outer periphery of the trampoline, said net is configured to couple to said plurality of supports such that said net substantially circumscribes the trampoline; and a sprinkling system formed integrally with at least one of said frame and said net, said cooling system comprising a plurality of discharge openings positioned a height above the trampoline for spraying cooling fluid radially inward above said trampoline, said plurality of discharge openings are spaced substantially circumferentially about said trampoline and are configured to be coupled in flow communication with a source of cooling fluid.

15. A cooling system in accordance with claim 14 wherein said sprinkling system discharge openings comprise a plurality of first openings positioned at a first height above the trampoline and a plurality of second openings positioned at a second height above the trampoline, wherein the first height is not equal to the second height, said plurality of discharge openings are each sized to discharge cooling fluid therefrom in a mist-like fashion.

16. A cooling system in accordance with claim 14 wherein said plurality of sprinkling system discharge openings comprise a plurality of first openings formed with a first diameter and a plurality of second openings formed with a second diameter that is larger than the first diameter.

17. A cooling system in accordance with claim 14 wherein at least one of said plurality of supports is hollow and is configured to be coupled in flow communication between said plurality of discharge openings and the source of cooling fluid.

18. A cooling system in accordance with claim 14 wherein at least one of said plurality of supports is hollow and comprises at least one opening formed therein, said opening is configured to be coupled in flow communication with the source of cooling fluid for discharging cooling fluid radially inwardly above the trampoline.

19. A cooling system in accordance with claim 14 wherein said frame comprises at least one lateral member extending between an adjacent pair of said plurality of supports, said at least one lateral member is hollow and comprises at least one opening for discharging cooling fluid radially inwardly above the trampoline mat.

* * * * *